US009873995B1

(12) United States Patent
Chen et al.

(10) Patent No.: US 9,873,995 B1
(45) Date of Patent: Jan. 23, 2018

(54) FLEXIBLE PIER

(71) Applicants: SHENZHEN WISE-TECH Engineering Consulting Co. LTD., Shenzhen, Guangdong Province (CN); Shenzhen Municipal Design & Research Institute Co., Ltd., Shenzhen, Guangdong Province (CN)

(72) Inventors: Xiachun Chen, Shenzhen (CN); Ruijuan Jiang, Shenzhen (CN); Weiming Gai, Shenzhen (CN); Yiyan Chen, Shenzhen (CN); Qiming Wu, Shenzhen (CN); Jucan Dong, Shenzhen (CN); Tianhua Xu, Shenzhen (CN)

(73) Assignees: SHENZHEN WISE-TECH ENGINEERING CONSULTING CO., LTD., Shenzhen (CN); SHENZHEN MUNICIPAL DESIGN & RESEARCH INSTITUTE CO., LTD., Shenzhen (CN)

( * ) Notice: Subject to any disclaimer, the term of this patent is extended or adjusted under 35 U.S.C. 154(b) by 0 days.

(21) Appl. No.: 15/498,030

(22) Filed: Apr. 26, 2017

(30) Foreign Application Priority Data

Nov. 10, 2016 (CN) ..... 2016 1 0990461

(51) Int. Cl.
*E01D 19/02* (2006.01)

(52) U.S. Cl.
CPC ..... *E01D 19/02* (2013.01)

(58) Field of Classification Search
CPC ..... E01D 19/02; E01D 19/125; E04B 2/56; E04B 1/08; E04B 1/32; E04C 2/32
See application file for complete search history.

(56) References Cited

U.S. PATENT DOCUMENTS 2,815,656 A * 12/1957 Klein ..... E01F 8/0023 52/169.1
3,820,295 A * 6/1974 Folley ..... E04B 1/08 52/270
4,099,359 A * 7/1978 Sivachenko ..... E01D 19/125 405/284
4,129,917 A * 12/1978 Sivachenko ..... E01D 2/04 14/6
4,186,541 A * 2/1980 Sivachenko ..... E01D 19/02 52/630
4,211,504 A * 7/1980 Sivachenko ..... E01D 19/125 405/124
4,618,287 A * 10/1986 Kinnan ..... E02D 3/08 405/216

(Continued)

*Primary Examiner* — Abigail A Risic
(74) *Attorney, Agent, or Firm* — Withrow & Terranova, P.L.L.C.; Vincent K. Gustafson

(57) ABSTRACT

A flexible pier comprising a pier body, wherein the pier body comprises a waveform steel tube and concrete filled in the waveform steel tube. The waveform steel tube includes a wave segment. The wave direction of the wave segment is in along the axial direction of the pier body. The waveform steel tube and the concrete support each other. The waveform steel tube may improve the compressive strength of the concrete. Therefore, the section of the pier can become smaller while keeping the same compression bearing capacity, which not only increases the flexibility of the pier, but also reduces the amount of the consumed materials.

10 Claims, 4 Drawing Sheets

(56) References Cited

U.S. PATENT DOCUMENTS

| | | | | | |
|---|---|---|---|---|---|
| 5,586,417 | A * | 12/1996 | Henderson | E02D 27/42 | 405/233 |
| 5,826,387 | A * | 10/1998 | Henderson | E02D 27/42 | 405/249 |
| 5,833,394 | A * | 11/1998 | McCavour | E02D 29/045 | 405/126 |
| 6,524,722 | B2 * | 2/2003 | Schluter | F16L 9/06 | 428/603 |
| 6,672,023 | B2 * | 1/2004 | Henderson | E02D 27/42 | 405/244 |
| 7,618,217 | B2 * | 11/2009 | Henderson | E02D 27/12 | 405/239 |
| 7,824,598 | B1 * | 11/2010 | Kim | B28B 1/44 | 249/125 |
| 2007/0000077 | A1 * | 1/2007 | Wilson | E01D 19/125 | 14/73 |
| 2008/0019779 | A1 * | 1/2008 | Henderson | E02D 5/38 | 405/237 |
| 2008/0196341 | A1 * | 8/2008 | Kang | E01D 19/02 | 52/292 |
| 2011/0030298 | A1 * | 2/2011 | Paul | E02D 27/01 | 52/294 |
| 2014/0305066 | A1 * | 10/2014 | Wilson | E01F 5/005 | 52/643 |
| 2017/0030096 | A1 * | 2/2017 | Pantelides | H04W 16/26 | |

* cited by examiner

FLEXIBLE PIER

TECHNICAL FIELD

The present invention relates to the field of bridge construction, and more particularly, to a flexible pier structure suitable for supporting at least one portion of a bridge.

BACKGROUND

A continuous rigid frame bridge is a widely used bridge form, and has many advantages including great spanning ability, convenient construction, smooth driving, etc. A structural form of pier-beam solid connection is usually used in continuous rigid frame bridges, therefore the number of supports and expansion joints may be reduced and the integrality and torsional performance may be enhanced by the pier beam consolidation.

Flexible piers are usually used for the pier beam consolidation in continuous rigid frame bridges, which may coordinate the deformation of the upper part and optimize the force bearing of the superstructure. Thin-wall reinforced concrete high piers are usually used in practice to ensure the flexibility of the piers of continuous rigid frame bridges, which limits the use of a continuous rigid frame bridge for a bridge crossing a river gorge with higher piers. Therefore, a middle and low flexible pier is needed to accelerate the promotion and application of this kind of bridge in the large number highway and urban bridges, considering that this kind of bridge performs well under earthquakes.

SUMMARY

To overcome the deficiencies of the prior art, the present invention provides a kind of pier that satisfies the flexible deformation requirement of middle and low piers.

The technical solution used in the present invention to solve the technical problem thereof is as follows.

A flexible pier including a pier body, wherein the pier body comprises a waveform steel tube and concrete filled in the waveform steel tube, and the waveform steel tube is provided with a wave segment, and the wave direction of the wave segment is in along the axial direction of the pier body, wherein the waveform steel tube and the concrete are supported by each other.

As a further improvement of the solution above, bolts are included, wherein the bolts are longitudinally and transversally distributed on a section of the pier body, and the two ends of a bolt are fixed with tube walls at the two opposite sides of the waveform steel tube, respectively.

As a further improvement of the solution above, the longitudinal bolts and the transversal bolts are distributed alternately along the height of the pier body.

As a further improvement of the solution above, longitudinal and transversal bolts are installed at a same level of the pier body, and the intersection of the longitudinal and transversal bolts are fixed through binding.

As a further improvement of the solution above, a flat segment is set on each of the upper and lower ends of the wave segment of the waveform steel.

As a further improvement of the solution above, the top of the waveform steel tube is welded to a plugged steel plate, and the periphery of the plugged steel plate exceeds that of the waveform steel tube, and the upper and lower surfaces thereof are welded with toggle pins.

As a further improvement of the solution above, the bottom of the waveform steel tube is welded to a base plate, and the periphery of the base plate exceeds the waveform steel tube.

As a further improvement of the solution above, the waveform steel tube is formed by welding several waveform steel plates into an integrity by a plurality of splicing waveform steel plates.

As a further improvement of the solution above, the waveform steel tube is a square tube.

As a further improvement of the solution above, the wave form of the waveform steel tube includes trapezoidal waves.

The present invention has the beneficial effects as follows.

1. The waveform steel tube may improve the compressive strength of the concrete. Therefore, under the same compression bearing capacity, the section of the pier can be smaller, which not only increases the flexibility of the pier, but also reduces the consumption of the materials.
2. The waveform steel tube has an accordion effect, and the bending rigidity can be ignored. Therefore, it will be able to effectively reduce the entire bending rigidity of the section, increase the flexibility of the pier, and satisfy the deformation consistency condition of the main beam and the pier.
3. The concrete casted inside the tube can improve the buckling resistance of the waveform steel tube, and then improve the shear bearing capacity and the torsion bearing capacity of the pier. This kind of flexible pier has a good deformability, which is good for withstanding seismic loadings. Meanwhile, it is suitable for the piers of various heights, and especially for large-span rigid frame bridges.

BRIEF DESCRIPTION OF THE DRAWINGS

Embodiments of the present invention are further described hereunder with reference to the drawings and embodiments, in which.

DETAILED DESCRIPTION

Figure 1:
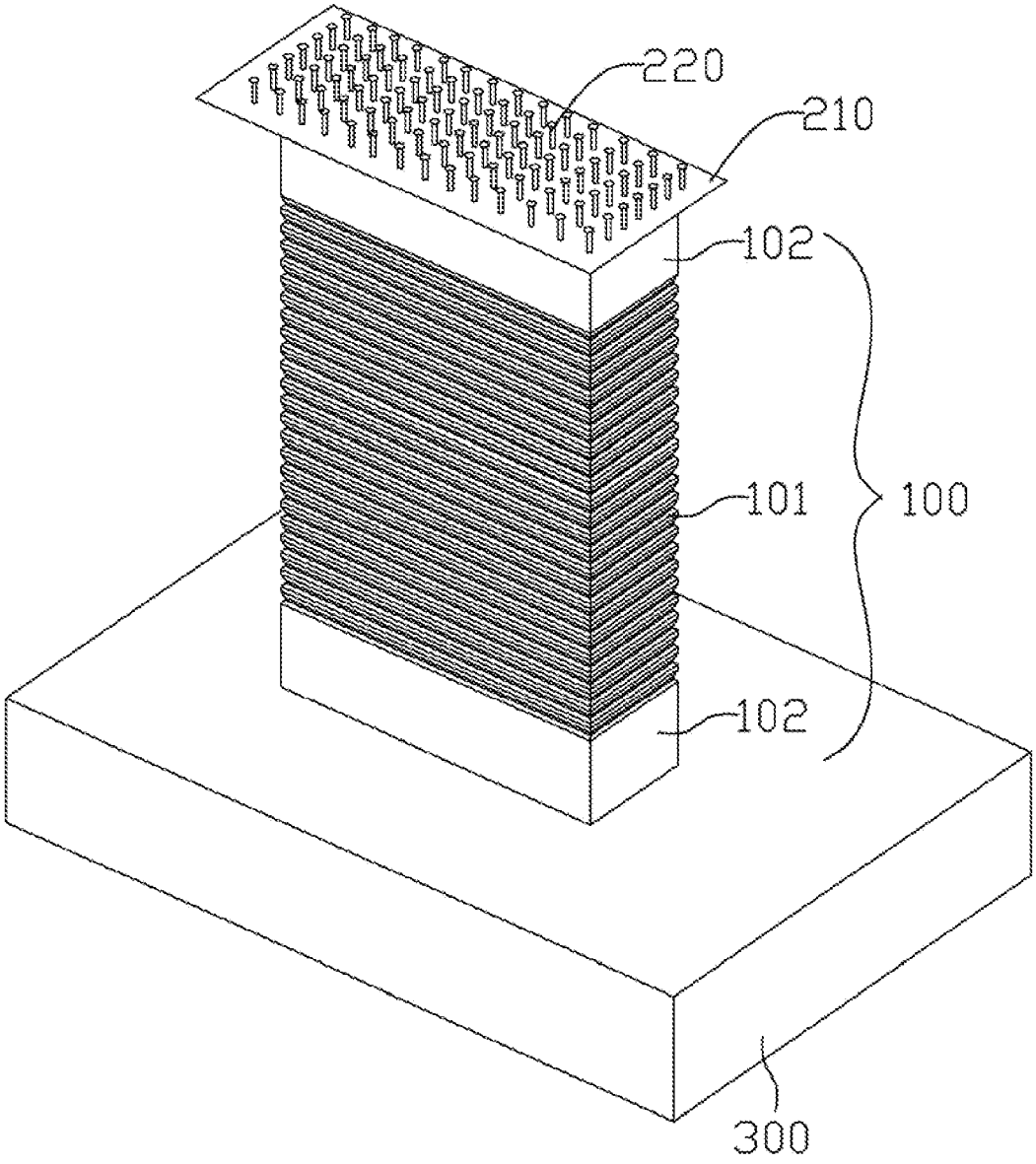
FIG. 1 is a three-dimensional schematic diagram of an embodiment of a flexible pier according to the present invention.

The conception, specific structure and resulting technical effects of the present invention will be clearly and completely described hereunder with reference to the embodiments and drawings, to permit one skilled in the art to sufficiently understand the objects, solutions and effects of the present invention. It should be illustrated that in case of no conflict, the embodiments according to the present invention and the technical features in the embodiments may be combined with each other.

It should be illustrated that, unless otherwise specifically stated, when some feature is referred to as being "fixed on" and "connected to" another feature, it can be directly fixed on and connected to another feature, or indirectly fixed on or connected to another feature. In addition, the descriptions of upper, lower, left, and right used in the invention are only relative to a mutual location relationship of each component of the invention in the drawings.

Furthermore, unless otherwise defined, all technical and scientific terms used in the text have the same meaning as commonly understood by those skilled in the art. The terms used in the description are only for the purpose of describing particular embodiments instead of limiting the present invention. The term "and/or" used in the text includes any combination of one or more related and listed items.

FIG. 1 shows a three-dimensional schematic diagram of an embodiment of a flexible pier according to the present invention, which includes a pier body, wherein the pier body includes a waveform steel tube 100 and concrete (not shown in the figure) filled in the waveform steel tube 100, a wave segment 101 is set on a tube wall of the waveform steel tube 100, and the wave direction of the wave segment is along the axial direction of the pier body.

plate (steel tube). However, waveform steel is used in the present invention for the steel plate (steel tube) of the concrete-filled steel tube pier. Because the bending stiffness of the section provided by the waveform plate can be ignored, the overall bending stiffness of the entire section is solely provided by the concrete and therefore can be effectively reduced. According to the data in Table I, when the thickness of the pier body of the pier is 0.4 m, the bending stiffness of the pier body section is significantly reduced, which is only 49% of the original value. With the increase of the thickness of the pier body, although the proportion of the bending stiffness contributed by the concrete is increased gradually, the reduction of the overall bending stiffness thereof is still obvious compared with that of the section of the plain plate concrete-filled steel tube pier (when the thickness of the pier body is 1.4 m, the bending stiffness is 77% of the original value). Therefore, the bending stiffness of the pier can be significantly reduced and the flexibility of the pier can be improved by the present invention.

TABLE I

| Longitudinal thickness of pier (m) | Horizontal width of pier (m) | Thickness of externally coated steel plate of pier (m) | Modulus of elasticity of steel plate (Gpa) | Modulus of elasticity of concrete (Gpa) | Longitudinal bending rigidity K1 of plain plate concrete-filled steel tube pier (*109N · $m^2$) | Longitudinal bending rigidity K2 of waveform steel plate concrete-filled steel tube pier (*109N · $m^2$) | K2/K1 |
|---|---|---|---|---|---|---|---|
| 0.4 | 5 | 0.01 | 210 | 34.5 | 1.60 | 0.79 | 0.49 |
| 0.6 | 5 | 0.01 | 210 | 34.5 | 4.69 | 2.79 | 0.60 |
| 0.8 | 5 | 0.01 | 210 | 34.5 | 10.24 | 6.79 | 0.66 |
| 1 | 5 | 0.01 | 210 | 34.5 | 18.95 | 13.48 | 0.71 |
| 1.2 | 5 | 0.01 | 210 | 34.5 | 31.53 | 23.52 | 0.75 |
| 1.4 | 5 | 0.01 | 210 | 34.5 | 48.69 | 37.63 | 0.77 |

According to the present invention, the waveform steel tube 100 and the concrete support and interact with each other to form a flexible pier. When compared with a regular reinforced concrete pier, since the hoop effect of the steel tube can improve the compressive strength of the concrete, a smaller pier section can be used to obtain the same compression bearing capacity, which not only improves the flexibility of the pier, but also reduces the amount of the consumed materials. On the other hand, the concrete casted inside may improve the buckling resistance of the waveform steel tube, and then improve the shear bearing capacity and the torsion bearing capacity of the pier. The flexible pier has better deformability and is favorable for seismic-bearing; meanwhile, the flexible pier can be suitable for piers of various heights, and especially suitable for the rigid frame bridges with large span.

According to the present invention, the outer waveform steel tube 100 has at least one wave segment, the bending stiffness of which can be ignored. Therefore, the overall bending stiffness of the section can be substantially reduced, and the deformation consistency condition between the main beam and the pier can be satisfied. In addition, when an earthquake occurs, the accordion effect of the waveform steel tube also provides a better energy dissipation capability, which can help mitigate the seismic effect. Table I shows the relationship between the longitudinal bending stiffness of a pier body section of a thin-wall rectangular concrete-filled steel tube pier with the longitudinal thickness of the pier. When a plain plate is used, the longitudinal bending stiffness of the concrete-filled steel tube pier is a sum of the bending stiffnesses provided by the concrete and the steel Preferably, a waveform steel tube 100 in the embodiment is formed by splicing and welding a plurality of steel plates, and the steel plates can be prefabricated in a factory. With on-site assembly and segment-wise casting, the bridge supports can be omitted, which makes the construction more convenient environmental friendly. Further, the waveform steel tube 100 in the embodiment is a rectangle square tube formed by splicing four steel plates. Of course, the section of the steel tube also can be a square, a round, an oval, and other shapes. In addition, the section of the steel tube can be either a uniform section, or a varying section.

In addition, a flat segment 102 is addicted to each of the upper and lower ends of the wave segment 101 of the waveform steel tube 100. The flat segment 102 is good for resisting larger bending moment at the upper and lower ends of the pier, and also beneficial to the construction of the structure herein. The flat segment 102 at the top of the waveform steel tube is welded to a plugged steel plate 210. The perimeter of the plugged steel plate 210 exceeds the waveform steel tube 100, and the upper and lower surfaces of the plugged steel plate are welded with at least one stud 220. The flat segment 102 at the bottom of the waveform steel tube 100 is welded to a base plate (that is not shown). The perimeter of the base plate also exceeds the waveform steel tube, and the base plate is embedded into a bearing platform 300 at the bottom of the pier body.

Figure 2:
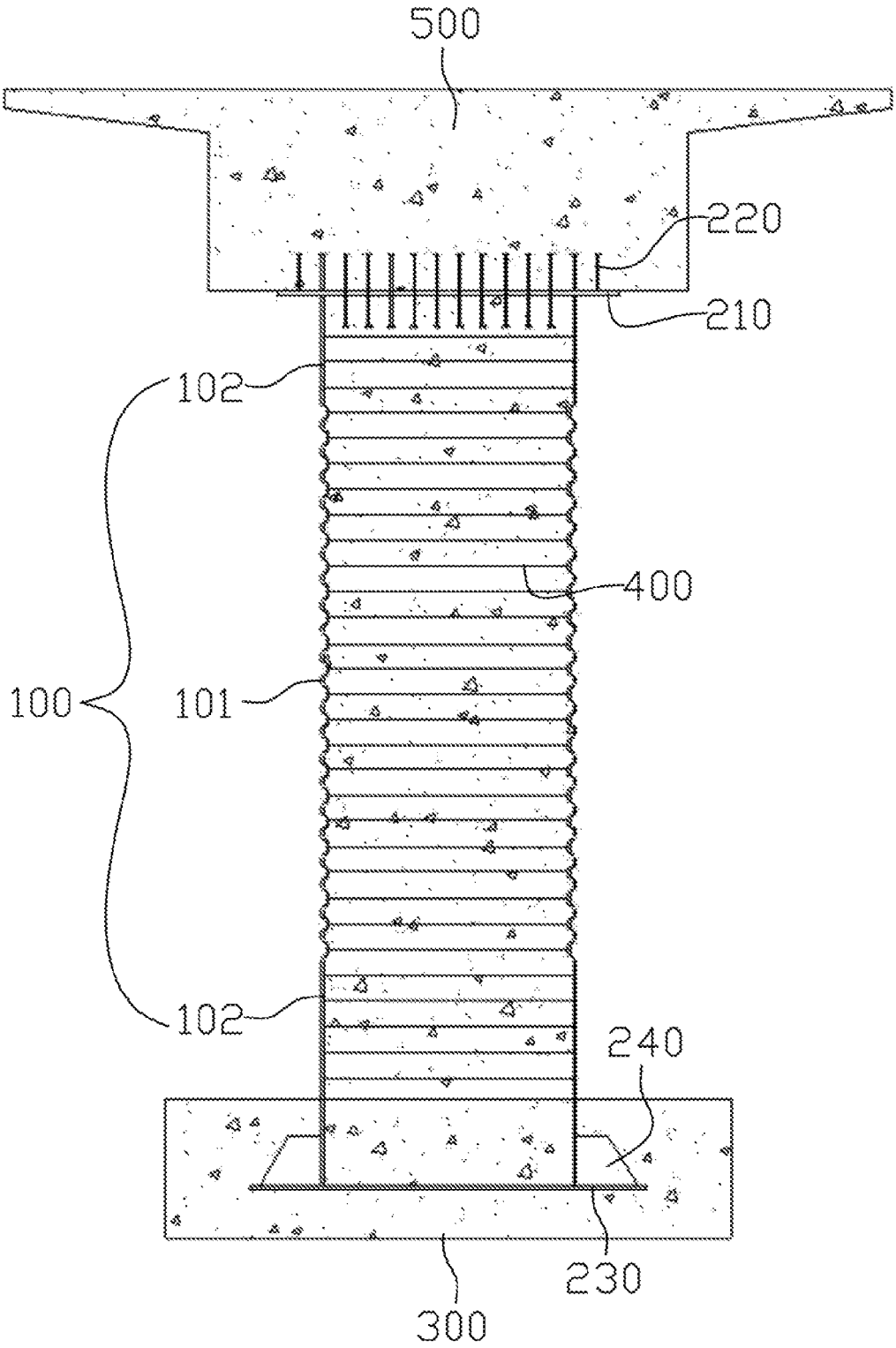
FIG. 2 is a schematic diagram of the front section of the flexible pier according to an embodiment of the present invention.
Figure 3:
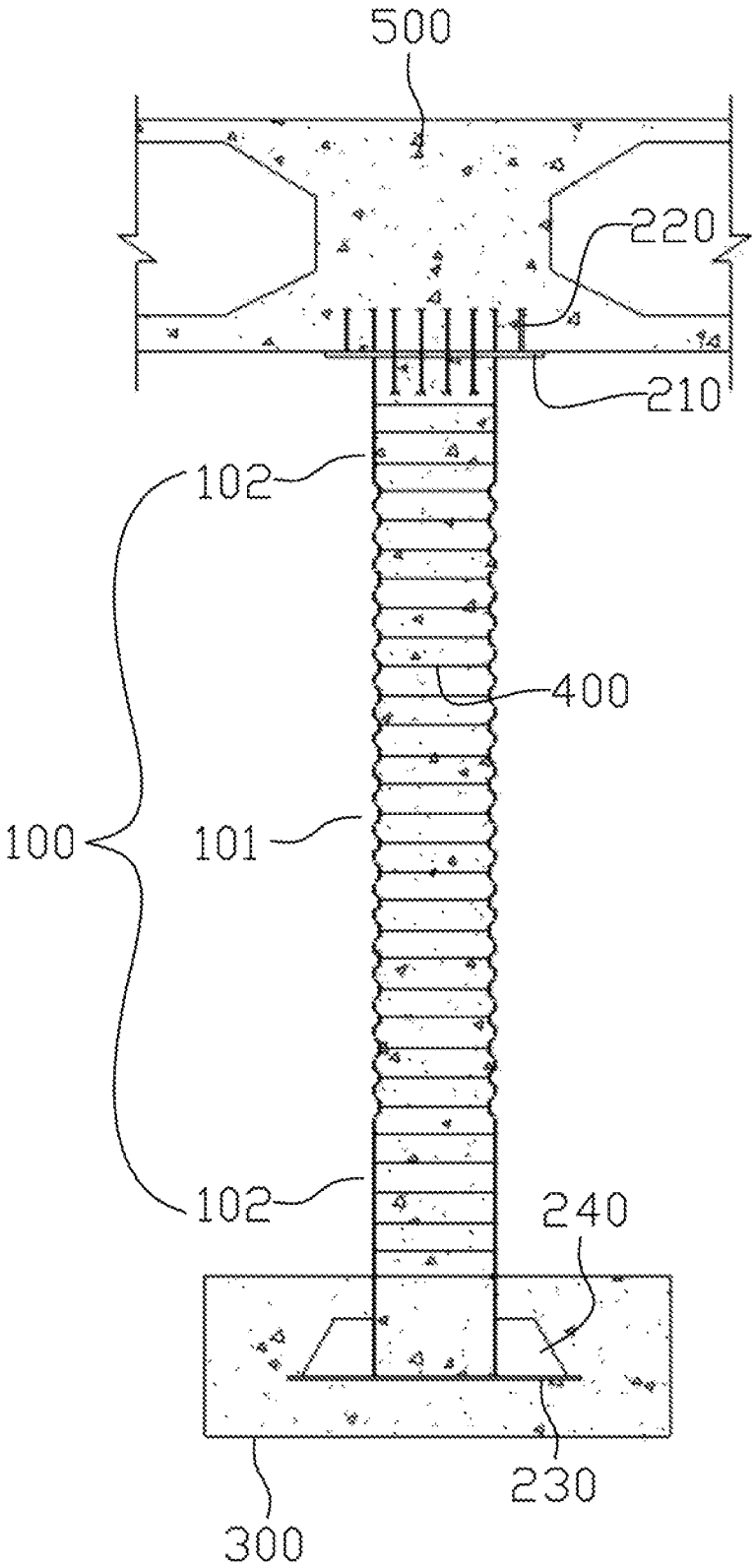
FIG. 3 is a schematic diagram of the lateral section of the flexible pier according to an embodiment of the present invention.

FIG. 2 and FIG. 3 show the cross-sections of the flexible pier along the longitudinal and transversal directions of the flexible pier, respectively. As shown in the figures, the flexible pier further includes bolts 400 The bolts 400 are longitudinally and transversely distributed (when viewed from the top portion) on the cross-section of the pier body (FIG. 2 shows the longitudinally distributed bolts and FIG. 3 shows the transversely distributed bolts). The two ends of the bolts 400 are fixed to the tube walls at the two opposite sides of the waveform steel tube, respectively. The bolts 400 can improve the stability of the steel tube in the casting process of the pier, and ensure that the compressive strength of the internal concrete can be improved by the hoop effect of the steel tube. Moreover, the shear bearing capacity of the pier can be increased when the pier is in use.

To be specific, taking the rectangle steel tube in the embodiment as an example, through holes are first drilled on the wall of the steel tube. The bolts 400 then pass through and are tightly combined with the internal concrete, and then are tied with the steel tube after they are extended out from the through holes. The transversal bolts 400 can tighten the steel plates at the left and the right sides of the rectangle steel tube 100. On the other hand, the longitudinal bolts 400 can tighten the two steel plates at the frond and the rear of the rectangle steel tube 100.

As a preferred embodiment for arranging the bolts, the longitudinal and transversal bolts are distributed alternatively along the height of the pier body. As another preferred embodiment for arranging the bolts, the longitudinal and transversal bolts are distributed at a same level of the pier body, wherein the intersection of the longitudinal and transversal bolts are fixed through binding.

The figures also show a platform 300 and a main beam 500, wherein the flat segment 102 at the bottom of the waveform steel tube is welded to a base plate 230, and the base plate 230 is embedded into the platform 300 at the bottom of the pier body, so as to fix the lower portion of the pier body. A stiffening plate 240 is set between the base plate 230 and the flat segment 102 to further reinforce the strength of the connection. The upper portion of the pier body is connected to the main beam 500 through the studs 220 on the plugged steel plate 210. In this way, the upper portion of the pier body can be fixed.

Figure 4:
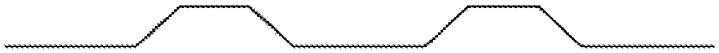
FIG. 4 is a schematic diagram of a wave form of a waveform steel tube according to an embodiment of the present invention.

FIG. 4 shows a schematic diagram of a wave form (wave profile) of a wave segment of a waveform steel tube according to one embodiment, wherein a trapezoidal shape is preferably used as the wave form. Of course, in other embodiments, a rectangle, a triangle, a circular arc, and other shapes can also be used as the wave form for a wave segment. A wave segment may include a repeating wave form that provides an accordion-like shape.

Preferred embodiments of the present invention are specifically illustrated by the contents above, but the present invention is not limited to the embodiments specifically provided herein. Those skilled in the art may also make various equivalent modifications or replacements without departing from the scope of the present invention, and these equivalent modifications or replacements shall all fall within the scope defined by the claims of the application.

What is claimed is:

1. A flexible pier, comprising a pier body that includes a waveform steel tube, wherein an interior of the waveform steel tube is filled with concrete, the waveform steel tube includes a wave segment having a wave direction extending along a height direction of the pier body, the waveform steel tube includes a first flat segment arranged above an upper end of the wave segment, the waveform steel tube includes a second flat segment arranged below a lower end of the wave segment, and the waveform steel tube and the concrete support each other.

2. The flexible pier according to claim 1, comprising a plurality of bolts extending through opposing tube walls of the waveform steel tube and the concrete within the interior of the waveform steel tube, wherein the plurality of bolts includes longitudinal bolts and transversal bolts distributed on at least a portion of the pier body, and each bolt of the plurality of bolts includes two ends that are fixed to two opposing tube walls of the waveform steel tube, respectively.

3. The flexible pier according to claim 2, wherein the longitudinal bolts and the transversal bolts are distributed in an alternating manner along the height direction of the pier body.

4. The flexible pier according to claim 2, wherein at least some longitudinal bolts and at least some transversal bolts are distributed at substantially a same level, and intersections of the longitudinal and transversal bolts distributed at substantially the same level are fixed through binding.

5. The flexible pier according to claim 1, wherein a top portion of the waveform steel tube is welded to a plugged steel plate having a perimeter that exceeds a perimeter of the waveform steel tube, and the plugged steel plate includes upper and lower surfaces from which welded studs extend.

6. The flexible pier according to claim 1, wherein a bottom portion of the waveform steel tube is welded to a base plate having a perimeter that exceeds a perimeter of the waveform steel tube.

7. The flexible pier according to claim 1, wherein the waveform steel tube is formed by welding a plurality of spliced waveform steel plates.

8. The flexible pier according to claim 1, wherein the waveform steel tube comprises a tube having a square cross-sectional shape.

9. The flexible pier according to claim 1, wherein a wave form of the wave segment of the waveform steel tube includes a trapezoidal shape.

10. The flexible pier according to claim 1, wherein the wave segment includes a repeating wave form that provides an accordion-like shape.

* * * * *